US005944037A

United States Patent [19]

Sinyong et al.

[11] Patent Number: 5,944,037

[45] Date of Patent: Aug. 31, 1999

[54] WATER SPRAY APPARATUS FOR TABLEWARE WASHING MACHINE

[75] Inventors: Kim Sinyong; Jo Yungman, both of Suwon, Rep. of Korea

[73] Assignee: Samsung Electronics Co., Ltd., Suwon, Rep. of Korea

[21] Appl. No.: 08/949,710

[22] Filed: Oct. 14, 1997

[30] Foreign Application Priority Data

| | | | |
|---|---|---|---|
| Oct. 16, 1996 | [KR] | Rep. of Korea | 96-46383 |
| Oct. 17, 1996 | [KR] | Rep. of Korea | 96-46595 |
| Dec. 10, 1996 | [KR] | Rep. of Korea | 96-47464 |
| Dec. 10, 1996 | [KR] | Rep. of Korea | 96-63885 |
| Dec. 10, 1996 | [KR] | Rep. of Korea | 96-63886 |

[51] Int. Cl.[6] ..... B08B 3/02

[52] U.S. Cl. ..... 134/176; 134/179; 134/198; 134/180; 239/243

[58] Field of Search ..... 134/198, 180, 134/181, 176, 179; 239/243, 245

[56] References Cited

U.S. PATENT DOCUMENTS

| | | |
|---|---|---|
| 1,408,077 | 2/1922 | Clinton . |
| 1,798,488 | 3/1931 | Orr . |
| 2,748,944 | 6/1956 | Kalinske . |
| 3,677,473 | 7/1972 | Belaieff . |
| 3,771,725 | 11/1973 | Jenkins et al. . |
| 3,797,509 | 3/1974 | Fukuzawa et al. . |
| 4,884,585 | 12/1989 | Oh . |
| 5,542,443 | 8/1996 | Yura et al. . |
| 5,655,556 | 8/1997 | Guerrera et al. . |
| 5,673,714 | 10/1997 | Campagnolo et al. . |

FOREIGN PATENT DOCUMENTS

| | | | |
|---|---|---|---|
| 504194 | 6/1920 | France | 134/179 |
| 2100590 | 7/1971 | Germany | 134/179 |
| 5-130964 | 5/1993 | Japan | 134/176 |
| 1286820 | 1/1972 | United Kingdom | 134/179 |

*Primary Examiner*—Frankie L. Stinson

*Attorney, Agent, or Firm*—Burns, Doane, Swecker & Mathis, L.L.P.

[57] ABSTRACT

A water spray apparatus for a tableware washing machine is provided. The water spray apparatus sprays water to tableware in a tableware washing machine in which a washing space is formed for washing the contained tableware with the sprayed water. The water spray apparatus includes a water spray having a plurality of nozzles, for spraying water while rotating and moving in such a non-circular pattern that a rotational radius varies along the inner walls of the tableware washing machine body enclosing the washing space. The water spray apparatus can spray water to the corners which are dead zones when the rotary spray rotates and sprays water in the washing space. Thus, a washing effect of the tableware washing machine is enhanced and utility of the washing space is increased.

14 Claims, 18 Drawing Sheets

WATER SPRAY APPARATUS FOR TABLEWARE WASHING MACHINE

BACKGROUND OF THE INVENTION

1) Field of the Invention

The present invention relates to a water spray apparatus for a tableware washing machine, and more particularly, to a water spray apparatus for spraying water to the four corners of the tableware washing machine which are distant from a circular rotating zone the structure of which rotates in the tableware washing machine and sprays water.

2) Prior Art Description

Table washing machines accommodates tableware such as dishes, knives, forks and spoons therein, takes up a certain amount of water from an external water source and sprays the water with a strong pressure using a pump and a spray nozzle instead of the human hands, in order to wash the leftover from the tableware. In order to enhance a washing effect of such a tableware washing machine, water should be uniformly sprayed toward the tableware. Accordingly, a rotary spray nozzle is used in the tableware washing machine. That is, if the spray nozzle rotates, water is sprayed in the rotation direction, with a result that the tableware can be uniformly washed.

FIG. 1 shows such a conventional tableware washing machine. A door 2 which is rotatably opened and closed is provided in one surface of the body 1 of the tableware washing machine. A washing space 3 is formed in the body 1. Two baskets 4 and 5 accommodating tableware (not shown) are loaded in the upper and lower sides on a sliding way, respectively. A water spray 6 is located under the lower basket 5. A spindle 7 is connected with the center of the water spray 6. The spindle 7 is rotatably supported by a connection tube 8 protruding from the bottom of the washing space 3. Thus, the water spray 6 can be rotated together with the spindle 7. A sump case 10 for collecting the water dripping from the bottom of the washing space 3 through a filter 9 and a pump 11 for pumping water of the sump case 10 are disposed on the bottom of the washing space 3. A discharging tube 12 of the pump 11 is connected with the water spray 6 via the connection tube 8 and the spindle 7. A plurality of nozzles 13 for spraying water toward the basket 5 are formed in the water spray 6. The plurality of nozzles 13 are designed in such a pattern that the spraying pressure of the water functions by means of the pump 11 so that the water spray 6 is rotated in one direction (see FIG. 2). That is, the water spray 6 is rotated without a particular driving power. Meanwhile, although not shown in the drawing, a water spray for spraying water in the same principle with a similar structure as in the lower basket 5 is installed under the upper basket 4. A reference numeral 14 denotes a heater, which dries the washed tableware.

Referring to FIG. 2 showing a tableware washing machine including a rotary water spray, tableware disposed in a circular zone where the water spray 6 moves is washed well within the rectangular washing space 3 defined by inner walls 15 of the tableware washing machine body. However, since corners 17 defined by the walls 15 except for the circular zone 16 form dead zones where the nozzles 13 of the water spray 6 do not influence within the rectangular washing space 3. As a result, tableware placed in the baskets in correspondence to the dead zones are not well washed. That is, a conventional rotary water spray 6 can enhance a washing effect of tableware via the rotary water spraying function. However, since the washing machine body 1 has a washing space of a plane contour which is not circular but rectangular, utility of the washing space is lowered.

SUMMARY OF THE INVENTION

To solve the above problems, it is an object of the present invention to provide a water spray apparatus for a tableware washing machine which can spray water while rotating and moving all over the tableware washing machine having a washing space of a plant contour which is not circular but rectangular.

To accomplish the above second object of the present invention, there is provided a water spray apparatus for spraying water to tableware in a tableware washing machine in which a washing space is formed for washing the contained tableware with the sprayed water, the water spray apparatus comprising: a water spray having a plurality of nozzles, for spraying water while rotating and moving in such a non-circular pattern that a rotational radius varies along the inner walls of the tableware washing machine body enclosing the washing space; means for supplying water to the water spray; and means for allowing the water spray to rotate.

The water spray includes a rotating main nozzle member which has a fixed length. An auxiliary nozzle member is connected with one or both ends of the main nozzle member. The auxiliary nozzle member can be designed in a manner that an end of the auxiliary nozzle member is bent, or is contracted telescopically when it contacts the walls. Here, a roller can be used for reducing a friction between the auxiliary nozzle member and the walls.

In the present invention, the auxiliary nozzle member contacts the walls according to the rotational position of the main nozzle member. In this case, the auxiliary nozzle member is positioned in the corner portions of the walls at the state when the auxiliary nozzle member is bent or contracted with respect to the main nozzle member. As a result, the auxiliary nozzle member, is spread or extended, to thereby spray water to the corner portions. That is, although the tableware washing machine is shaped as a plane contour which is a non-circular such as a rectangle, water can be sprayed all over the entire areas along the plane contour.

DETAILED DESCRIPTION OF THE INVENTION

Figure 1:
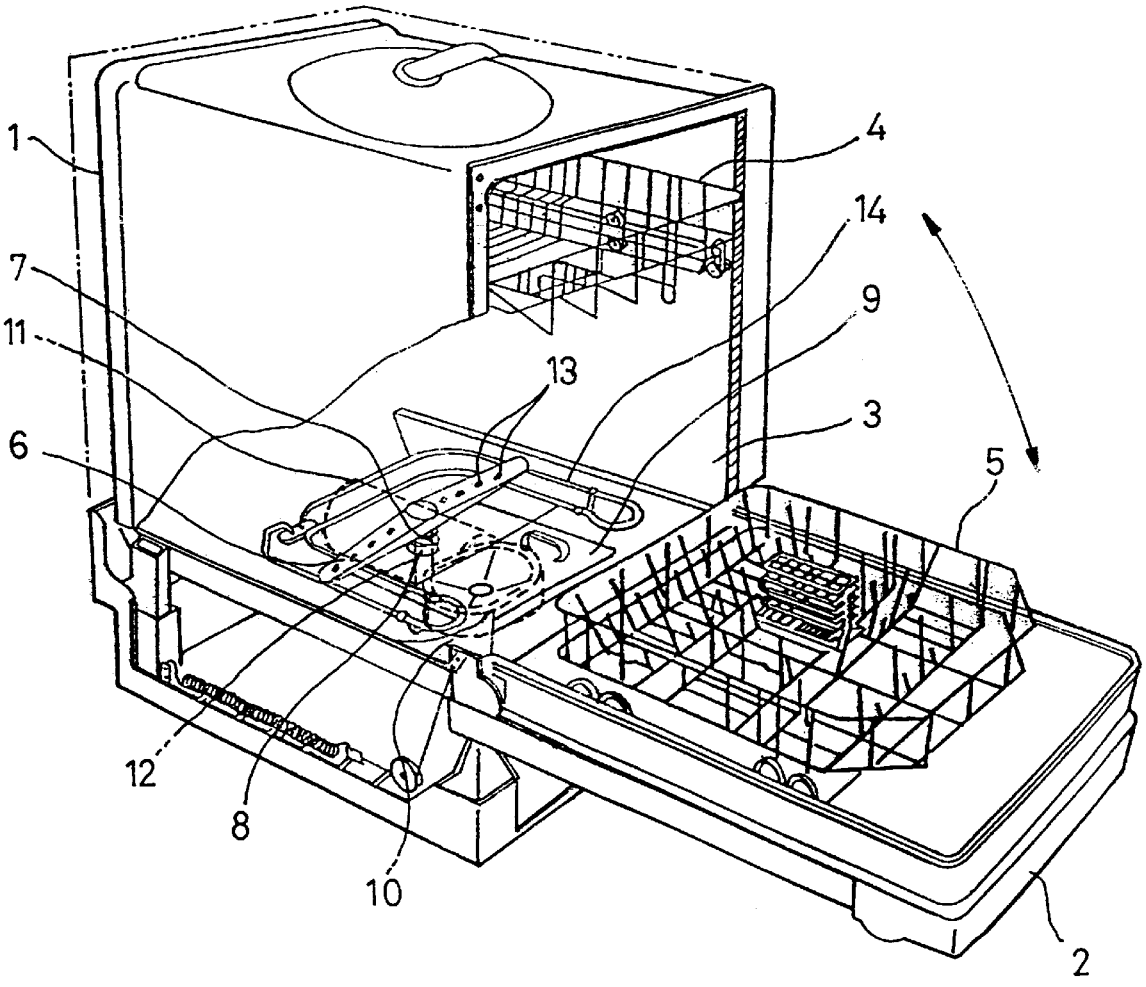
FIG. 1 (PRIOR ART)
FIG. 1 is a partly exploded perspective view of a tableware washing machine for explaining a conventional water spray apparatus for use in a tableware washing machine.
Figure 2:
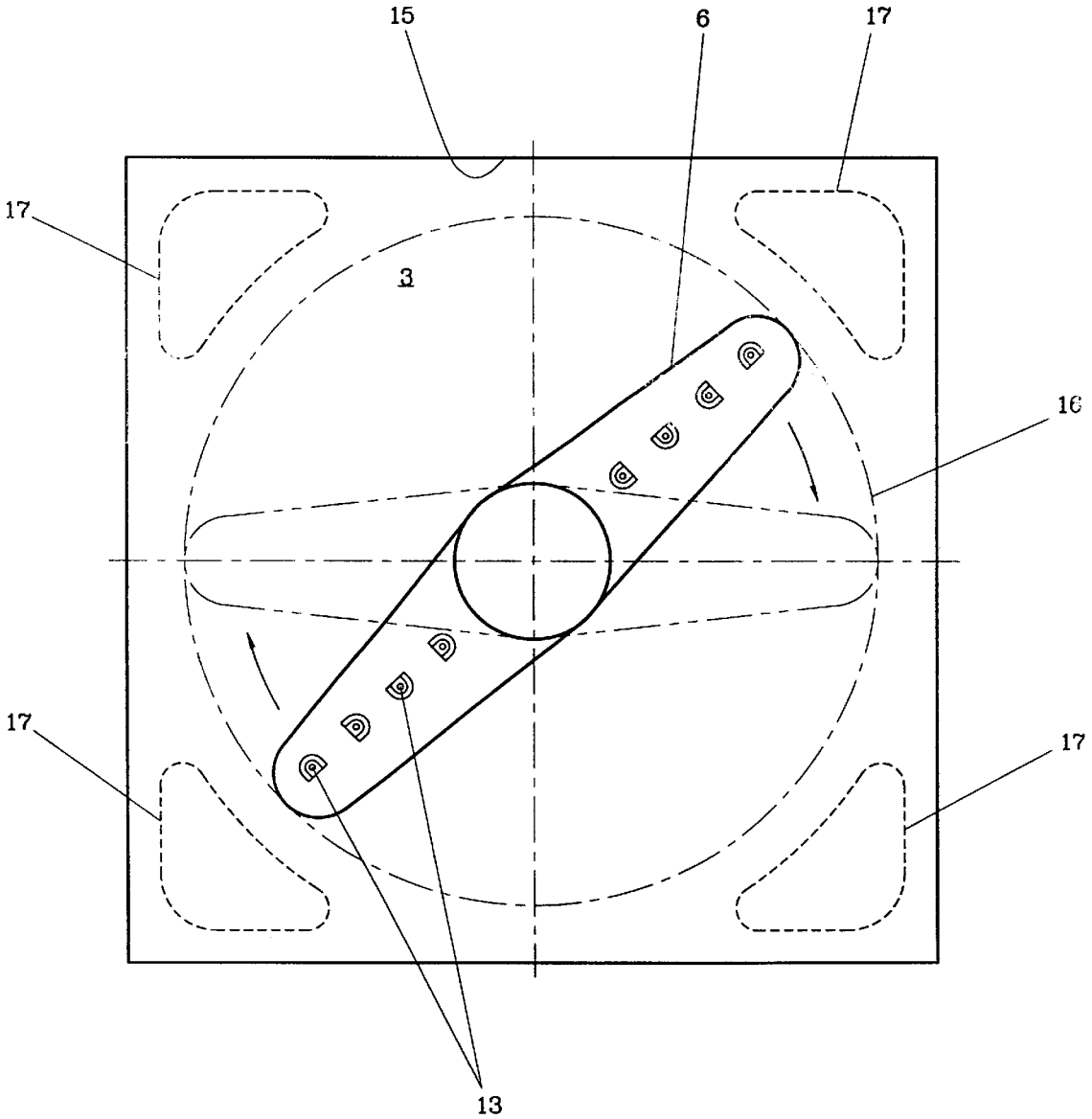
FIG. 2 (PRIOR ART)
FIG. 2 is a plan view showing a spraying zone of a conventional water spray apparatus of a tableware washing machine.
Figure 3:
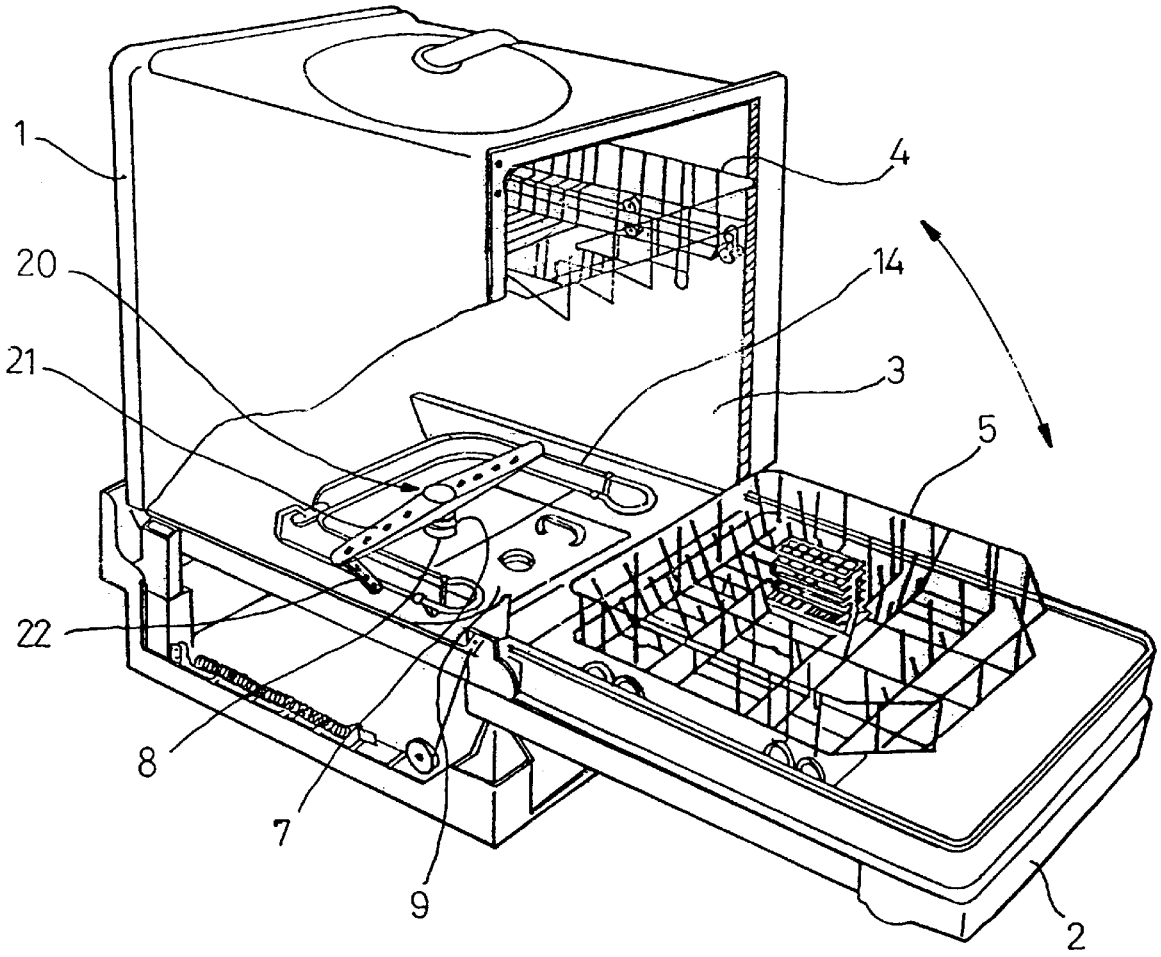
FIG. 3 is a partly cut-off perspective view of a tableware washing machine having a water spray apparatus according to a first embodiment of the present invention.

Preferred embodiments of the present invention will be described with reference to the accompanying drawings. FIGS. 3 through 14 show a water spray apparatus of a tableware washing machine according to a first embodiment of the present invention. Hereinafter, the same reference numerals are assigned with respect to the same elements as those of FIGS. 1 and 2. In FIG. 3, reference numeral 1 denotes the body of the tableware washing machine. Reference numeral 2 denotes a door. Reference numeral 3 denotes a washing space. Reference numerals 4 and 5 denote baskets in which tableware is contained. Reference numeral 7 denotes a spindle. Reference numeral 8 denotes a connection tube. Reference numeral 9 denotes a filter. Reference numeral 14 denotes a heater. Reference numeral 20 denotes an improved water spray according to the present invention.

The improved water spray 20 includes a main nozzle member 21, and an auxiliary nozzle member 22 which is connected to one end of the main nozzle member 21 so that the auxiliary nozzle member 22 can be bent. The auxiliary nozzle member 22 can be connected to the other end of the main nozzle member 21 in the same way as that of the one end thereof. The main nozzle member 21 and the auxiliary nozzle member 22 have a plurality of nozzles 23 and 24, respectively. The nozzles 23 formed in the main nozzle member 21 are designed in a manner that the main nozzle member 21 rotates in one direction by a spraying pressure when water is sprayed as described above. If the main nozzle member 21 rotates, it is natural that the auxiliary nozzle member 22 connected with the main nozzle member 21 rotates.

Figure 4:
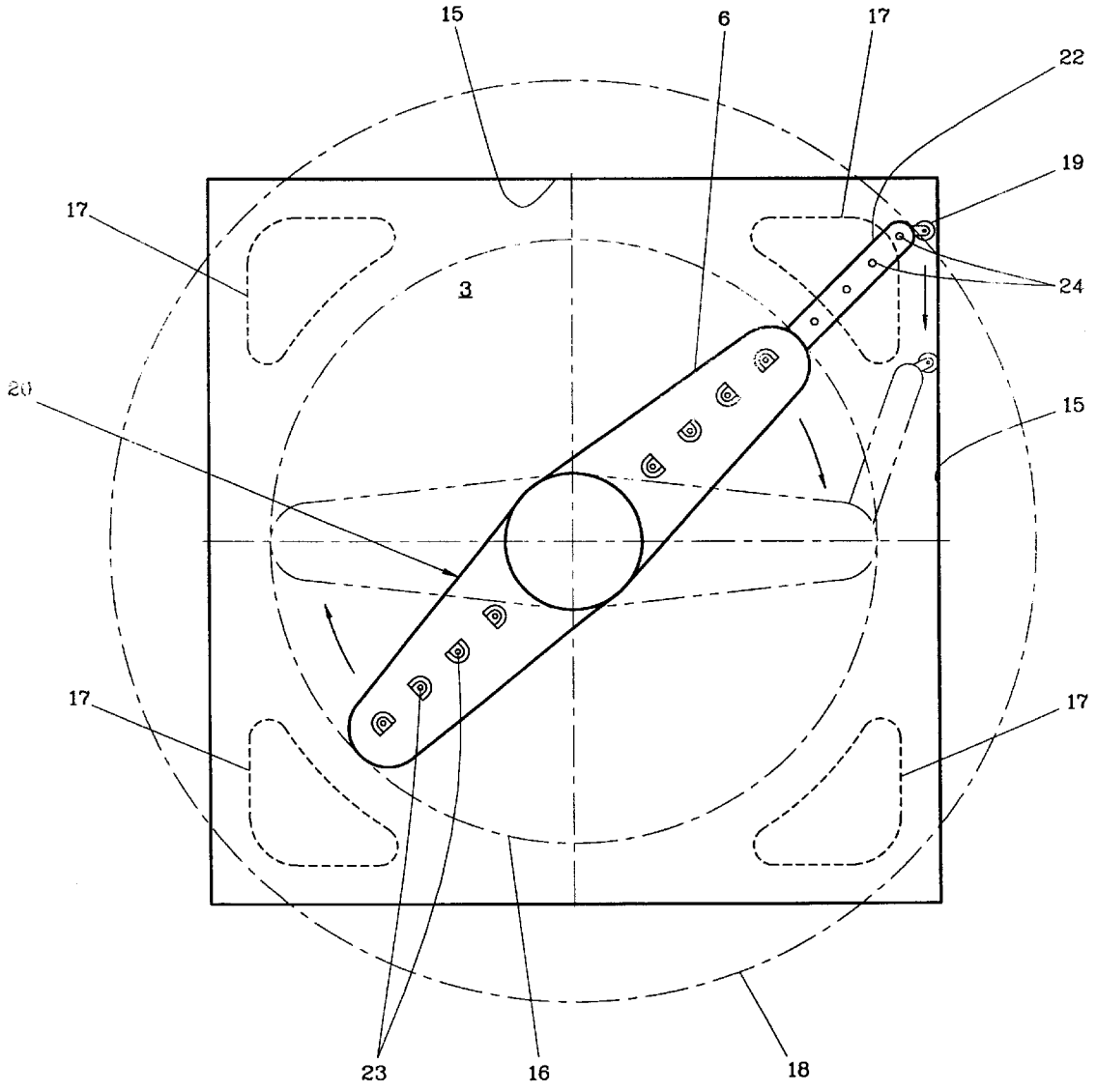
FIG. 4 is a plan view showing an operation of the water spray apparatus of the tableware washing machine shown in FIG. 3.

Referring to FIG. 4, the main nozzle member 21 rotates in a circular zone 16 having an allowable radius within a washing space 3 and sprays water as in the conventional tableware washing machine. The auxiliary nozzle member 22 has a circular zone 18 having a larger radius than that of the main nozzle member 21. When the auxiliary nozzle member 22 moves near the portions except for corner portions 17 of walls 15, the end portion of the auxiliary nozzle member 21 is pressed by the walls 15 and is bent. As a result, the auxiliary nozzle member 21 moves around a non-circular zone of which rotational radius varies substantially in correspondence to the walls 15 and sprays water. Thus, the water can be sprayed to the corners 17 where the water does not reach from the main nozzle member 21. A roller 19 attached in the end of the auxiliary nozzle member 22 contacts the walls 15 on a rolling basis to thereby reduce a friction therebetween.

Figure 5A:
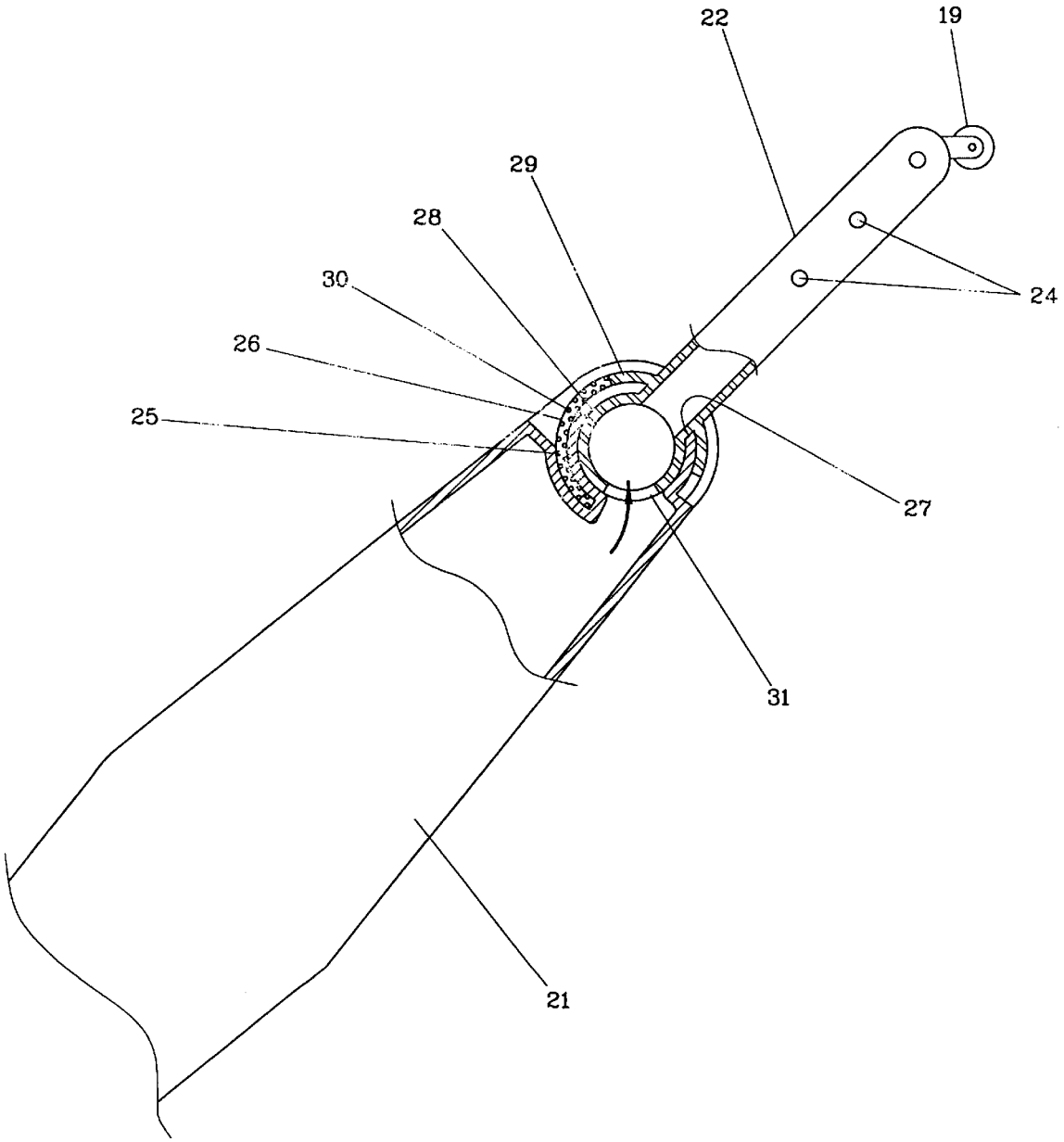
FIG. 5*a* is a partly cut-off plan view of the water spray apparatus shown in FIG. 4.
Figure 5B:
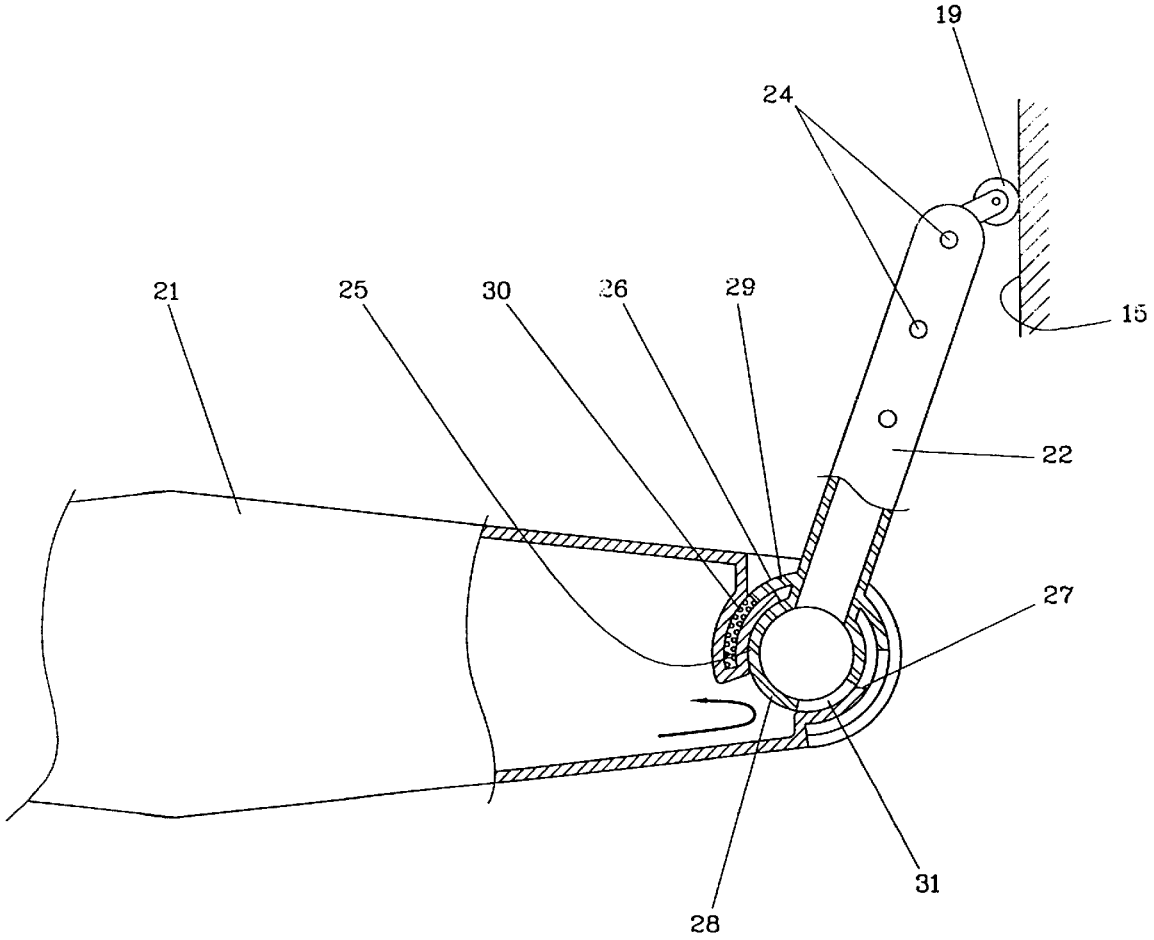
FIG. 5*b* is a partly cut-off plan view of the water spray apparatus shown in FIG. 4 in which an auxiliary nozzle member is bent.
Figure 6:
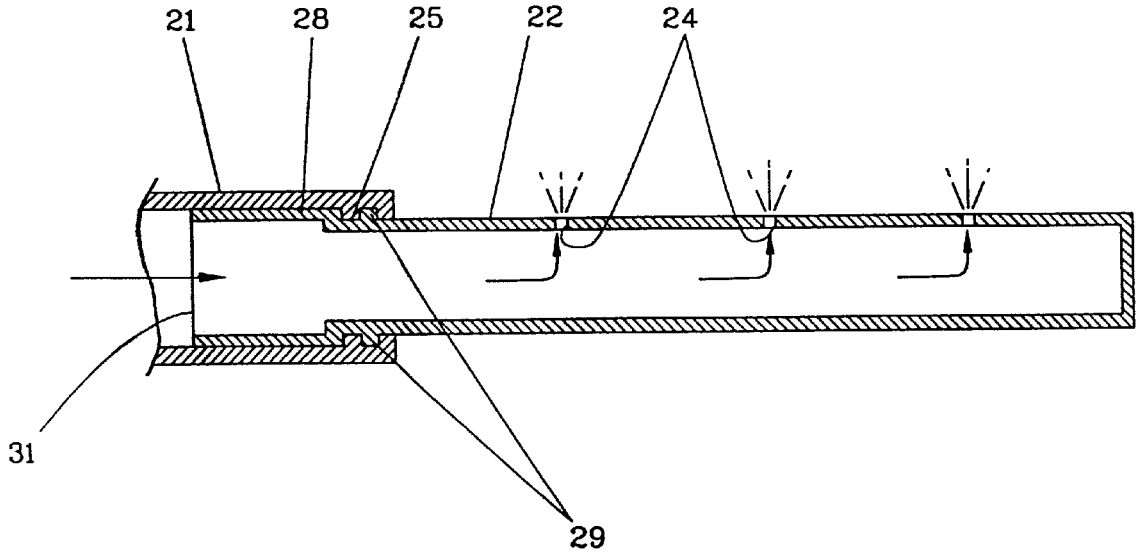
FIG. 6 is a cross-sectional view showing that water is supplied from the main nozzle member to the auxiliary nozzle member and sprayed at the state of FIG. 5*a*.

Referring to FIGS. 5*a* and 5*b*, a hinge accommodator 25, a guiding groove 26 and a stopper 27 are concentrically formed in the end of the main nozzle member 21. In correspondence thereto, a hinge portion 28 which is rotatably accommodated in the hinge accommodator 25 and a guiding rib 29 which moves along the guiding groove 26 are provided in the auxiliary nozzle member 22. A spring 30 inserted into the guiding groove 26 elastically presses the guiding rib 29, to make the auxiliary nozzle member 22 rotate in the clockwise direction. The stopper 27 stops the clockwise rotation of the auxiliary nozzle member 22 at the state shown in FIG. 5*a* so that the auxiliary nozzle member 22 does not rotate any more. On the contrary, when the auxiliary nozzle member 22 is pressed by the walls 15, the spring 30 is contracted, which can make the auxiliary nozzle member rotate to a certain extent in the counterclockwise direction, as shown in FIG. 5*b*. The auxiliary nozzle member 22 has an opening 31 formed in the hinge portion 28 as well. The opening 31 is opened and closed according to the rotational position of the auxiliary nozzle member 22. If the opening 31 is open as shown in FIG. 5*a*, water is introduced from the main nozzle member 21 to the auxiliary nozzle member 22 via the opening 31. The introduced water is filled in the main nozzle member 22 as shown in FIG. 6, and then sprays upwards via nozzles 24 formed thereon.

Figure 7:
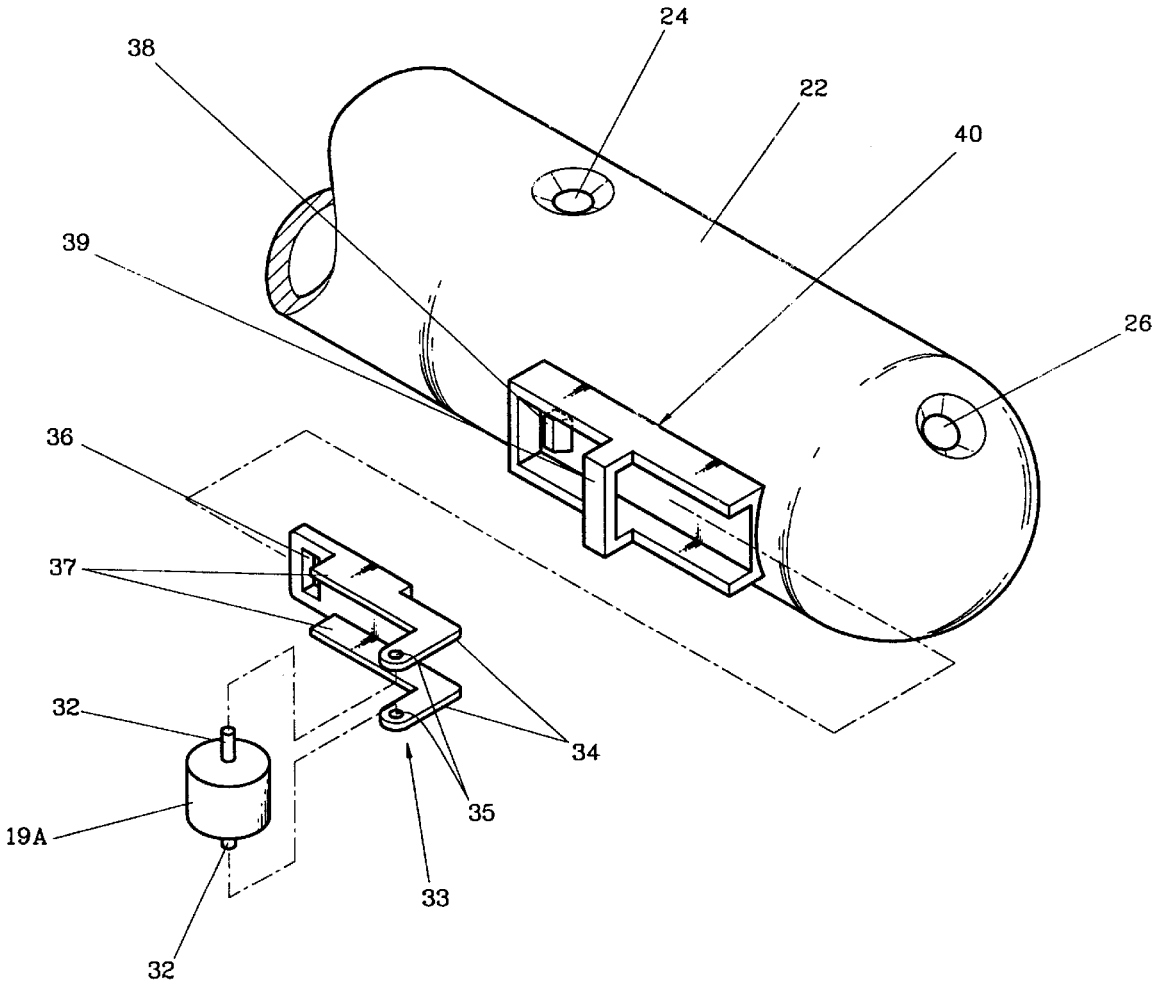
FIG. 7 is an exploded perspective view showing a roller support structure of an auxiliary nozzle member according to the first embodiment of the present invention.
Figure 8:
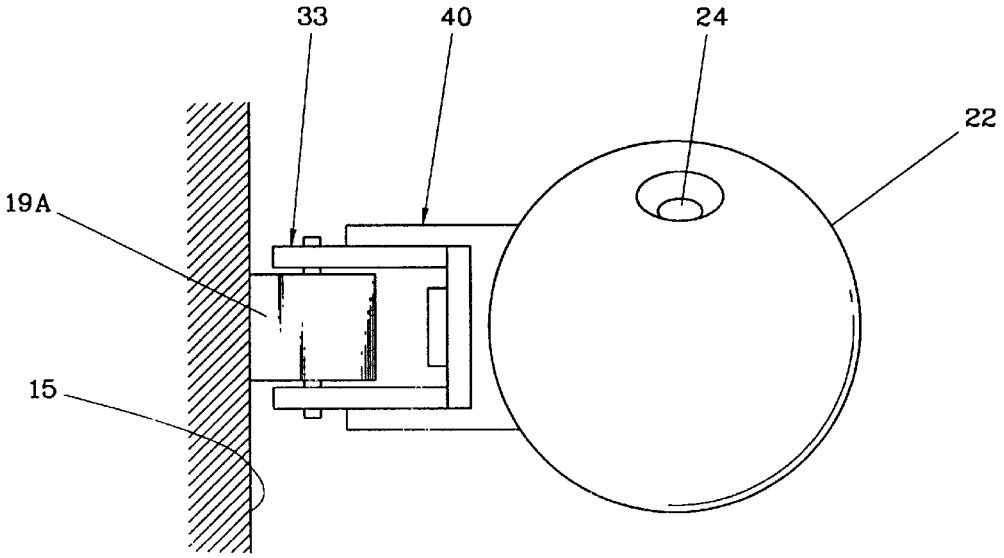
FIG. 8 is a side view showing a connection state of FIG. 7.
Figure 9:
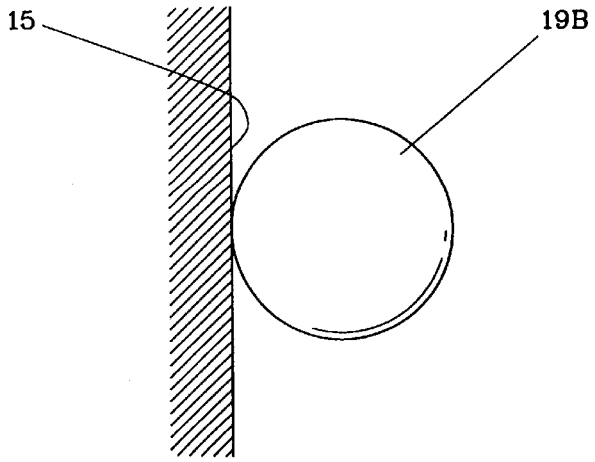
FIG. 9 is a side view showing the state when a spherical roller is used instead of a cylindrical roller shown in FIG. 7.

FIG. 7 shows the structure of supporting a roller 19A of the auxiliary nozzle member 22. The roller 19A has a cylinder and pins 32 protruding on the upper and lower surfaces of the cylinder. A roller bracket 33 has support pieces 34 having pin holes 35 for supporting the pins 32 of the roller 19A, and an engaging hole 36 and engaging jaws 37 for preventing detachment. A bracket holder 38 is integrally formed in the auxiliary nozzle member 22 or separately attached from the auxiliary nozzle member 22. The bracket holder 38 has an engaging protrusion 39 and a retainer 40 which correspond to the engaging hole 36 and the engaging jaws 37 of the roller bracket 33, respectively. FIG. 8 shows a state where the cylindrical roller 19A frictionally contacts the walls 15. FIG. 9 shows the state where a spherical roller 19B is used instead of the cylindrical roller 19A. The cylindrical roller 19A linearly contacts the walls 15. On the contrary, the spherical roller 19B contacts the halls on a point to point contact way, thereby reducing a contact resistance.

Figure 10:
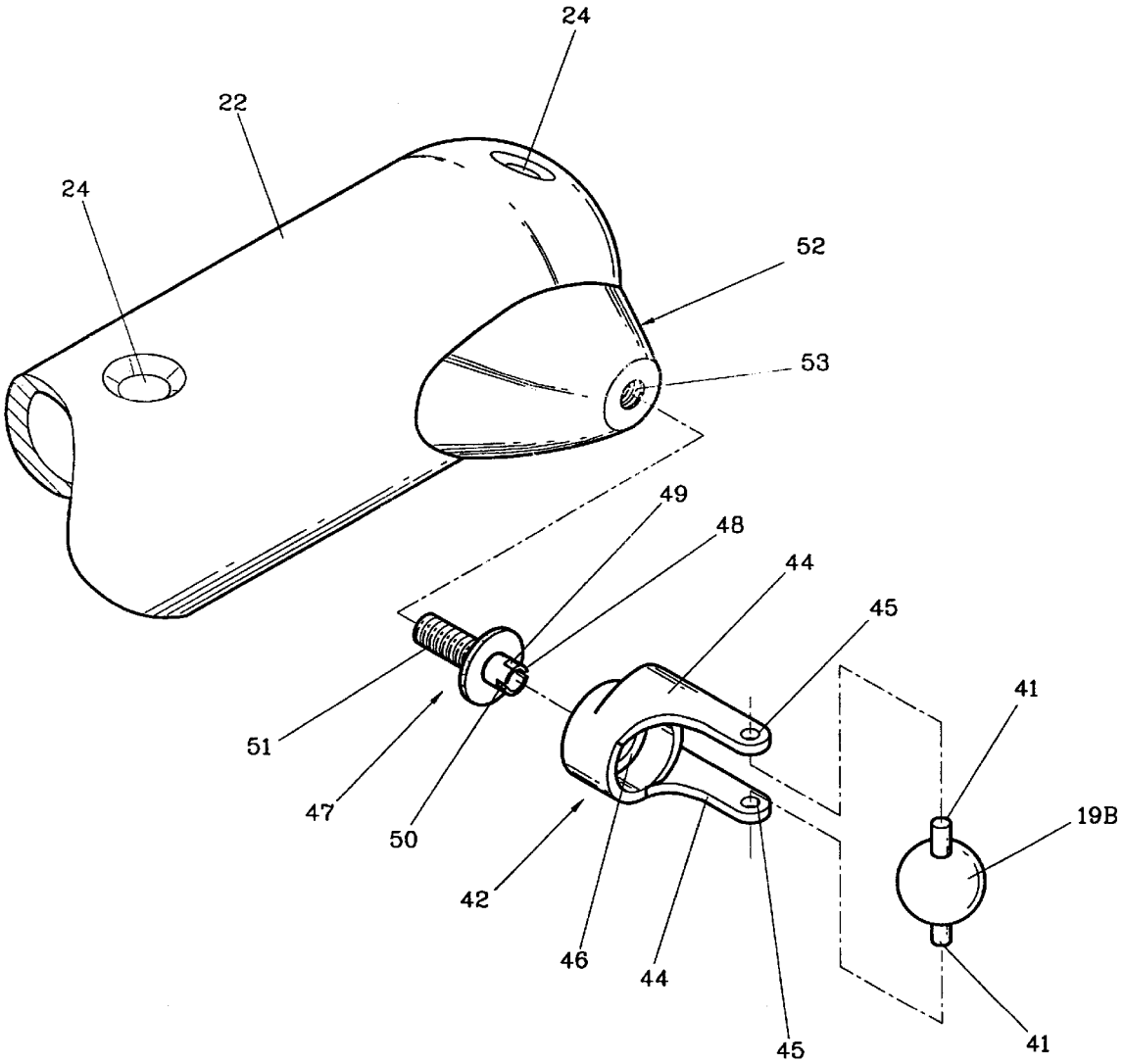
FIG. 10 is an exploded perspective view showing another example of a roller support structure of an auxiliary nozzle member according to the first embodiment of the present invention.
Figure 11:
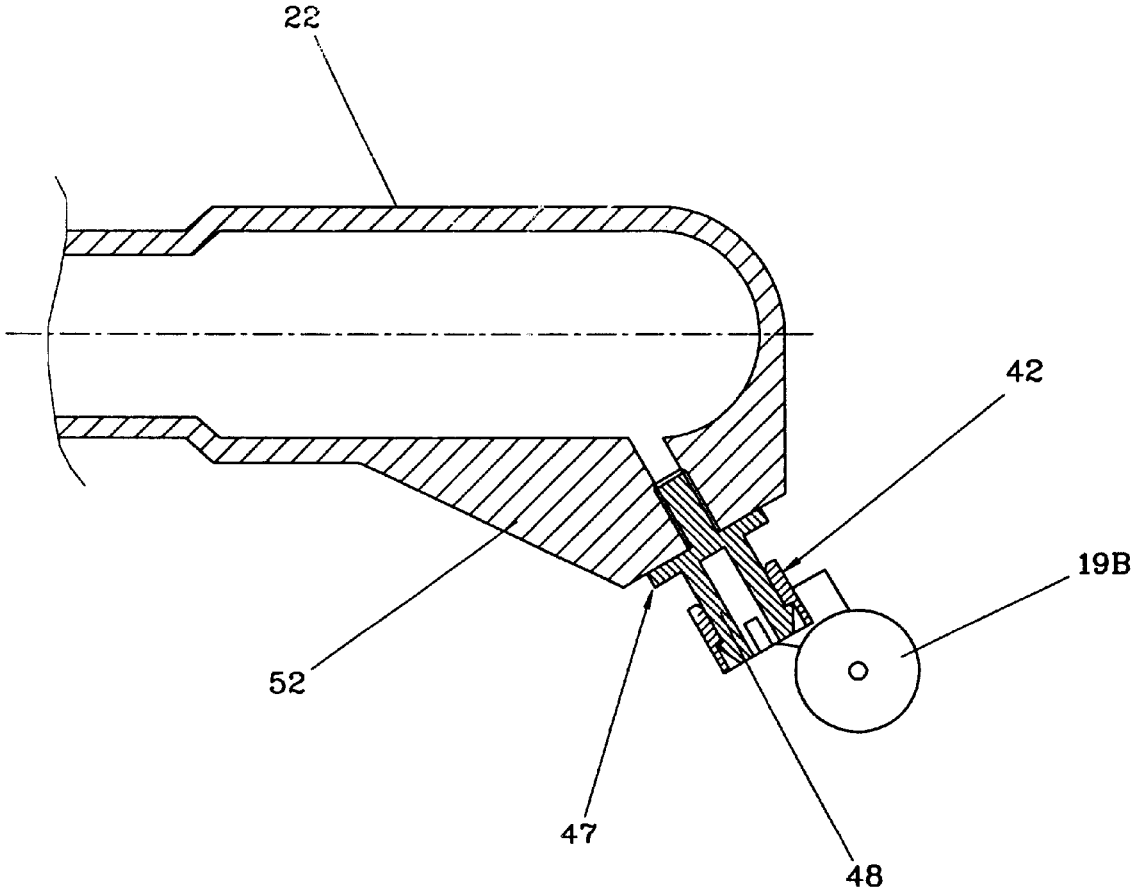
FIG. 11 is a sectional view showing a connection state of FIG. 10.
Figure 12A:
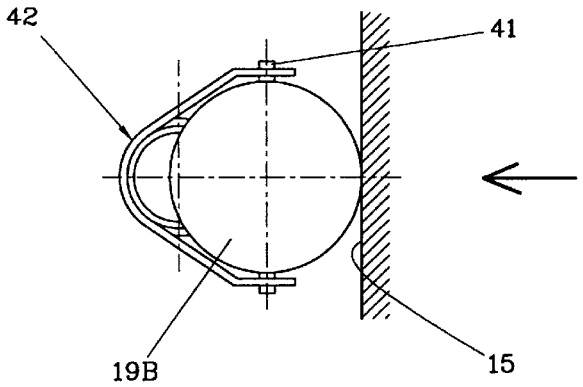
FIGS. 12*a*, 12*b* and 12*c* are side views showing postures where the roller shown in FIG. 11 corresponds to the vibrations of the walls.
Figure 12B:
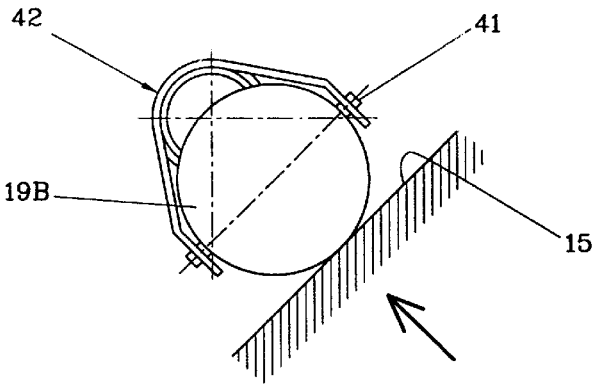
Figure 12C:
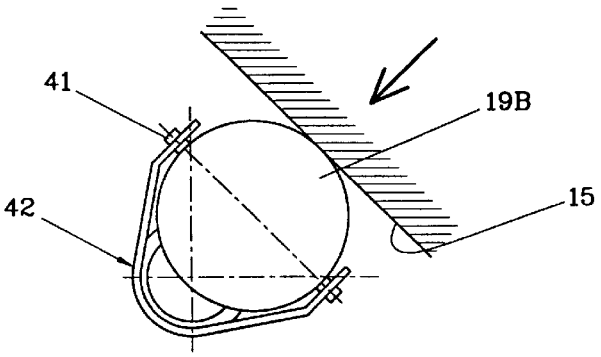

FIGS. 10 and 11 shows another example of a roller support structure of the auxiliary nozzle member 22. A roller bracket 42 of the spherical roller 19B is rotatably supported in a roller supporter 52 of the auxiliary nozzle member 22 via a rotational support ring 47. The roller bracket 42 is cylindrical and has support wings 44 on which a respective pin hole 45 for supporting each pin 41 of the spherical roller 19B, and an annular engager 46 which is formed in the cylindrical body. The rotational support ring 47 has a boss 48 which is fitted into the roller bracket 42, a hook 49 which is formed in the periphery of the boss 48 and engaged with the annular engager 46, an opening portion 50 which facilitates the hook 49 to enter, and a thread portion 51 which is formed opposing to the boss 48. A thread groove 53 with which the thread portion 51 of the rotational support ring 47 is engaged is formed in the support portion 52 of the auxiliary nozzle member 22. Here, the cylindrical roller 19A can be used instead of the spherical roller 19B. In order to engage the rotational support ring 47 with the thread groove 53 of the support portion 52, a separate screw can be used instead of the thread abortion 51. In such a structure, the roller bracket 42 is not detached by the hook 49 of the rotational support ring 47 which is engaged into the annular engager 46, but rotates around the boss 48. Thus, when the auxiliary nozzle member 22 rotates, it is inclined according to its weight, or when the auxiliary nozzle member 22 vibrates perpendicularly with respect to the rotational plane by inner or outer certain factors, it rotates in correspondence to the vibration direction as shown in FIGS. 12*a* through 12*c*. As a result, the pin 41 of the roller 19B and the walls 15 maintain a posture in parallel with each other. Thus, a smooth contact rotation of the roller 19B can be accomplished irrespective of inclination or vibration of the auxiliary nozzle member 22. A phenomenon that the auxiliary nozzle member 22 hesitates to contact the walls 15 due to its friction therebetween can be removed when the auxiliary nozzle member 22 rotates.

Figure 13:
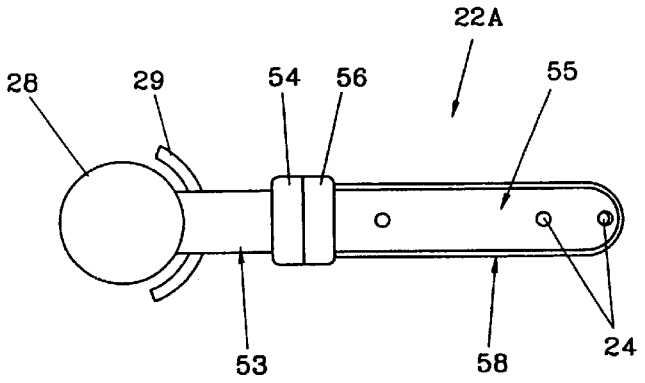
FIG. 13 is a plan view showing a modified example of the auxiliary nozzle member according to the first embodiment of the present invention.
Figure 14:
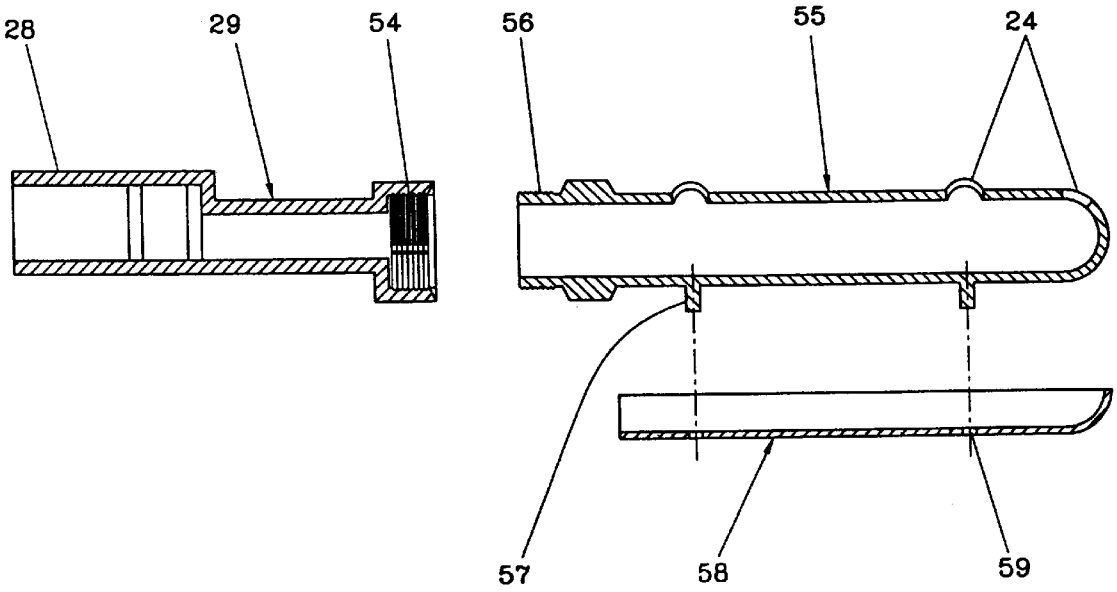
FIG. 14 is an exploded sectional view of the auxiliary nozzle member shown in FIG. 13.

FIGS. 13 and 14 show the structure of an auxiliary nozzle member 22A. The auxiliary nozzle member 22A includes a connection tube 53 and the nozzle tube 55. An additional plate 58 is added under the nozzle tube 55 in order to prevent a thermal variation. The connection tube 53 has a hinge portion 28 and the guiding rib 29 which are connected with the hinge accommodator and the guiding groove of the above-described main nozzle member. The nozzle tube 55 has a plurality of nozzles 24, a male thread portion 56 which is threaded connected to a female thread portion 54 of the connection tube 53, and protrusions 57 for fixing the additional plate 58. The additional plate 58 has holes into which the protrusions 57 are fitted, and is installed to enclose the bottom of the nozzle tube 55 by welding the protrusions 57. The nozzle tube 55 of the auxiliary nozzle member 22A is threaded connected with the connection tube 53. Accordingly, when the nozzle 24 is clogged or damaged in use, the nozzle tube 55 can simply separated from or connected with the connection tube 53 during repair or replacement. A material of high durability with respect to heats such as metal is used as the additional plate 58. Accordingly, the nozzle tube 55 is prevented from being thermally varied due to the heater 14 for a drying function of the tableware washing machine shown in FIG. 3. The same roller support structure can be applied in the nozzle tube 55 of the auxiliary nozzle member 22A, as the above-described roller support structure. Also, the additional plate 58 for preventing thermal variation can be added to the auxiliary nozzle member 22.

Figure 15:
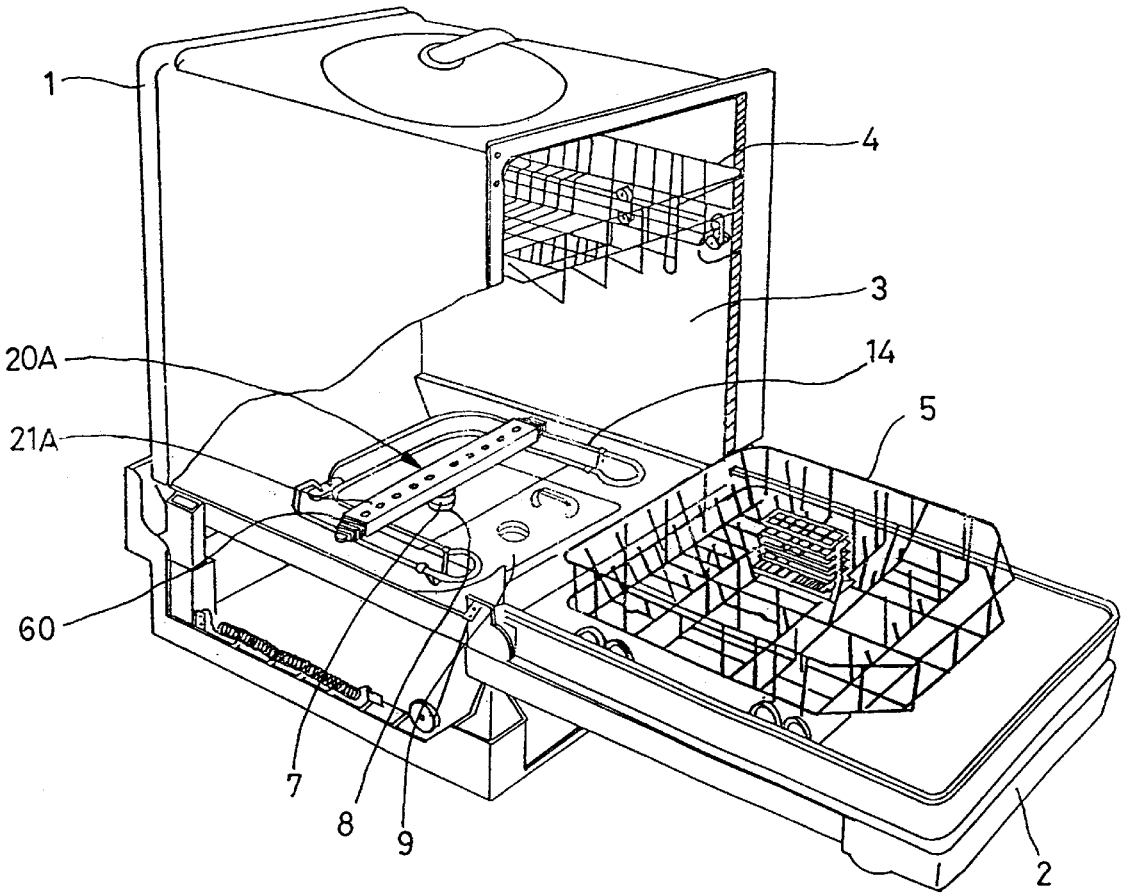
FIG. 15 is a partly cut-off perspective view of a tableware washing machine having a water spray apparatus according to a second embodiment of the present invention.

Next FIGS. 15 through 20 are views involving a water spray apparatus of a tableware washing machine according to a second embodiment of the present invention, In FIG. 15, reference numeral 1 denotes the body of the tableware washing machine. Reference numeral 2 denotes a door. Reference numeral 3 denotes a washing space. Reference numerals 4 and 5 denote baskets in which tableware is contained. Reference numeral 7 denotes a spindle. Reference numeral 8 denotes a connection tube. Reference numeral 9 denotes a filter. Reference numeral 14 denotes a heater. Reference numeral 20A denotes a telescopic water spray according to the present invention.

Figure 16:
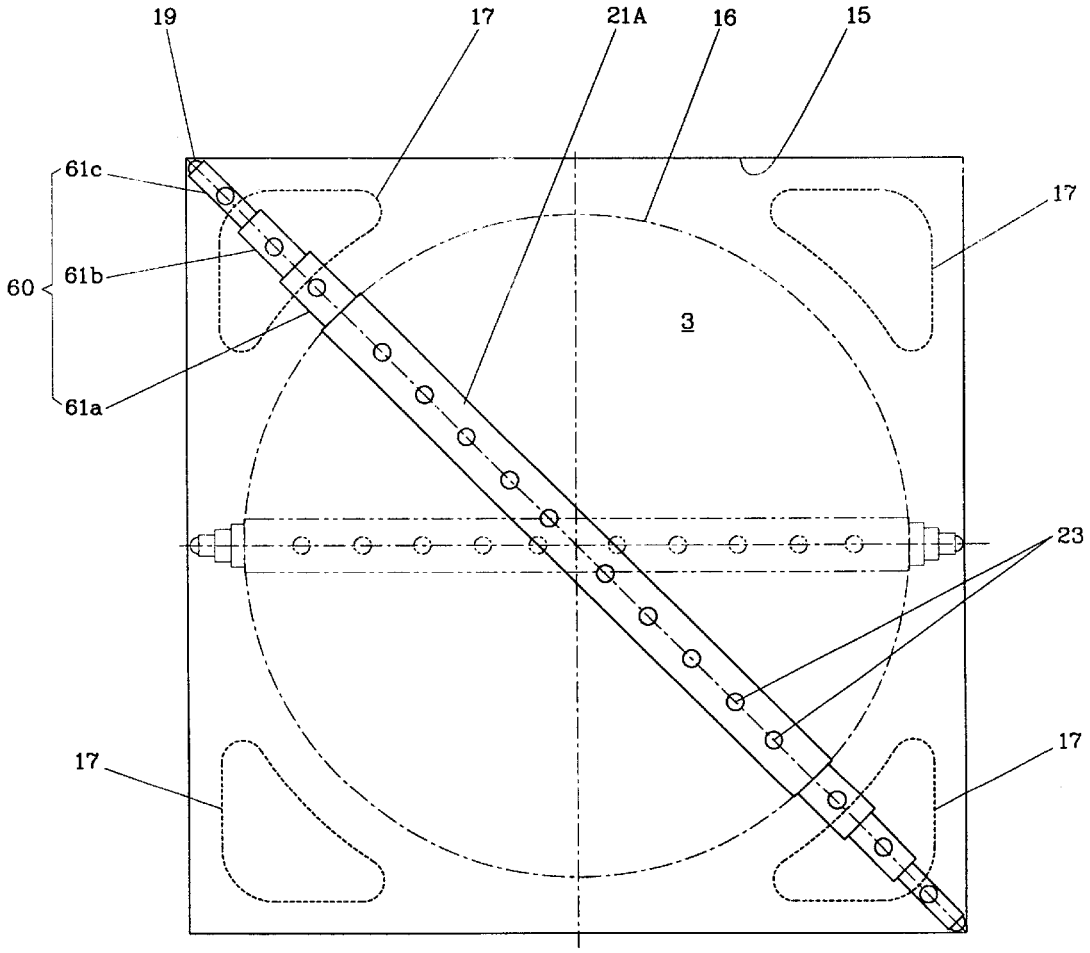
FIG. 16 is a plan view showing an operation of the water spray apparatus of the tableware washing machine shown in FIG. 15.
Figure 17:
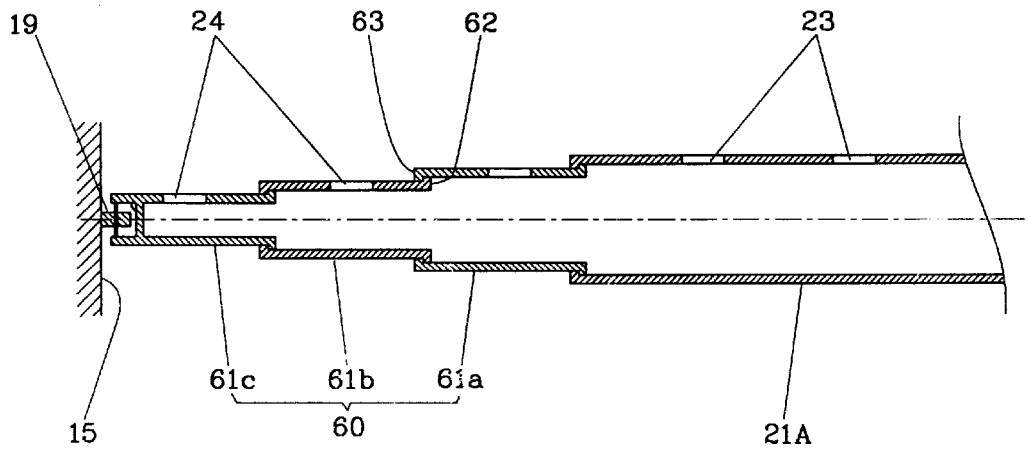
FIG. 17 is a sectional view showing the state in which a telescopic nozzle member of FIG. 16 is extended.
Figure 18:
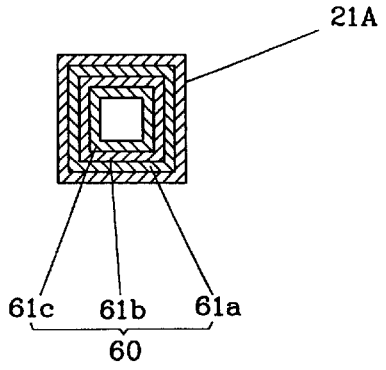
FIG. 18 is a sectional view showing a telescopic water spray used in the water spray apparatus of the tableware washing machine according to the second embodiment of the present invention.

The telescopic water spray apparatus 20A is made by connecting a contractible nozzle member 60 whose length is varied to the main nozzle member 21A. The main nozzle member 21A has a plurality of nozzles 23 which can rotate by a spraying pressure of water as described above. The contractible nozzle member 60 includes a plurality of nozzle tubes 61*a*, 61*b* and 61*c* as shown in FIG. 16. The nozzle tubes 61*a*, 61*b* and 61*c* are inserted into a nozzle tube having a larger sectional area than the other nozzle tube including a main nozzle tube as shown in FIGS. 17 and 18, respectively and accommodate the other nozzle tubes smaller than its own sectional area. Accordingly, during rotation of the main nozzle member 21A, the main nozzle member 21A protrudes in the direction of extending the length of the main nozzle member 21A by its centrifugal force and the introduced water pressure therein. The nozzle tubes 61*a*, 61*b* and 61*c* are not prevented from being detached in the direction of extending the length by outer stoppers 62 which are formed in one end and inner stoppers 63 which are formed in the other end, respectively. The roller 19 for contacting the walls 15 of the tableware washing machine body on a rolling contact manner is attached to the nozzle tube 61*c*.

Referring back to FIG. 16, the main nozzle member 21A sprays water using the circular zone 16 rotating at a given diameter. The contractible nozzle member 60 rotates at the state where it has been pressed by the walls 15 and then contracted as shown in a virtual line according to the rotational position of the main nozzle member 21A. Then, the contractible nozzle member 60 is extended according to the centrifugal force and the pressure of the introduced water at the corners 17 defined by the walls 15, in which case water is sprayed from the nozzles 24 formed on each exposed nozzle tube 61*a*, 61*b* and 61*c* as shown in a solid line. Thus, water can be sprayed to the corners 17 which are not influenced by the main nozzle member 21A.

Figure 19A:
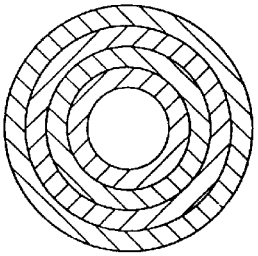
FIGS. 19*a*, 19*b*, 19*c* and 19*d* are sectional views showing various sectional shapes of the telescopic water spray used in the water spray apparatus of the tableware washing machine according to the second embodiment of the present invention.
Figure 19B:
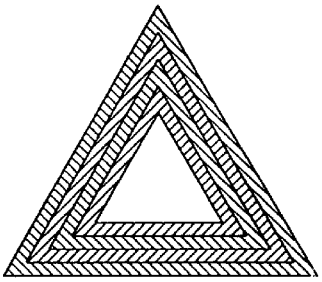
Figure 19C:
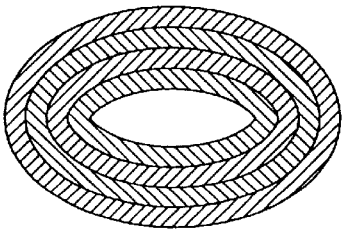
Figure 19D:
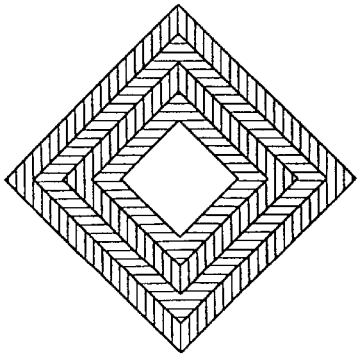

The main nozzle member 21A and the nozzle tubes 61*a*, 61*b* and 61*c* of the contractible nozzle member 60 have various sectional shapes such as a circle (FIG. 19*a*), a triangle (FIG. 19*b*), an oval (FIG. 19*c*) and a rhombus (FIG. 19*d*).

Figure 20:
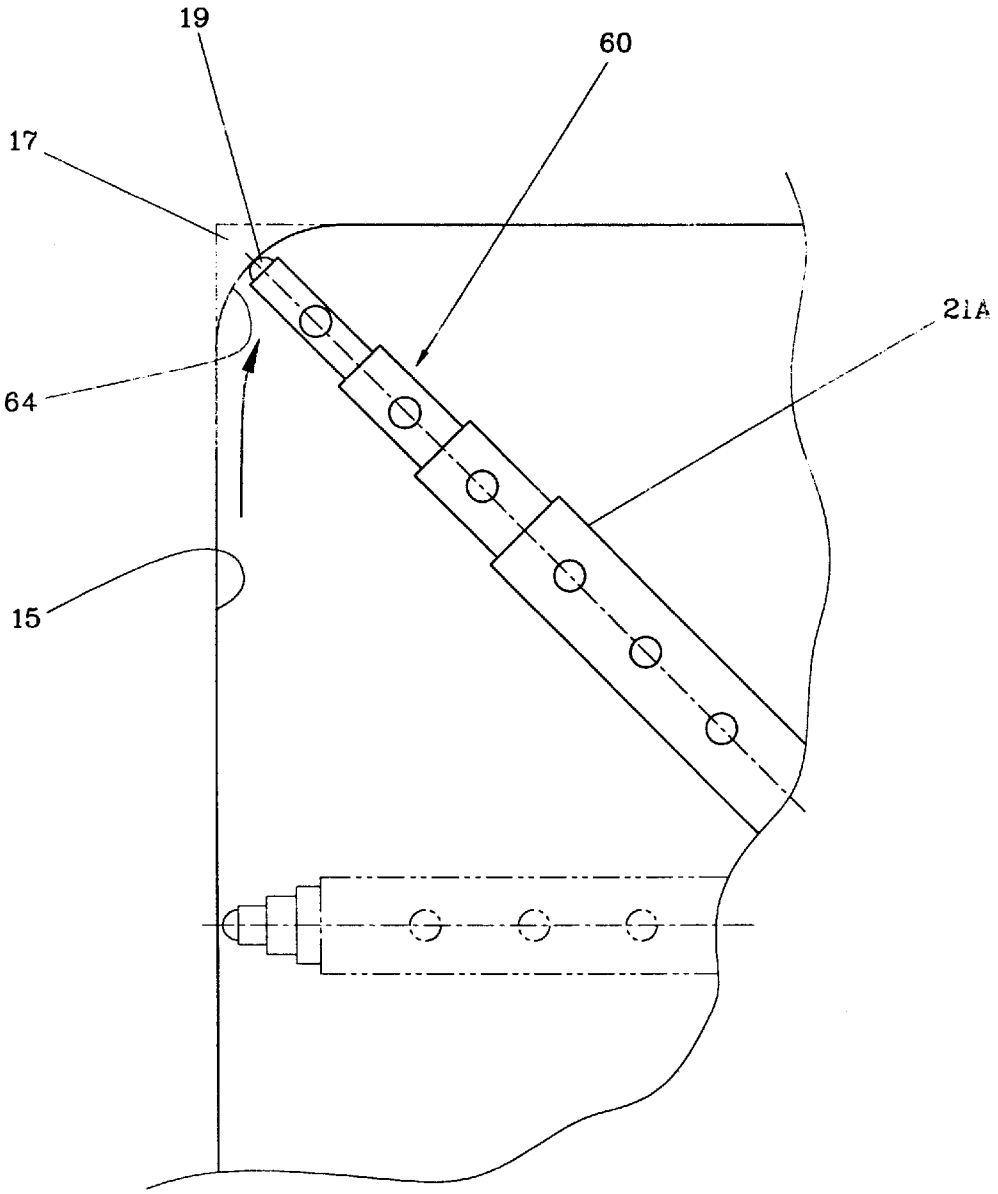
FIG. 20 is a plan view of a preferable wall of the tableware washing machine body to which the water spray apparatus is applied according to the second embodiment of the present invention.

Meanwhile, FIG. 20 shows a preferable wall of the tableware washing machine body to which the telescopic water spray 20A is applied. Here, the corner 17 defined by the walls 15 is formed as an arc 64 not a straight angle. The arc 64 allows the roller 19 to smoothly contact and move at the corner 17, to thereby reduce impact noise and assist the contractible nozzle member 60 to smoothly perform a contraction function with respect to the main nozzle member 21A.

As described above, the tableware washing machine having a washing space of a plane contour such as a rectangle and a non-circle, according to the present invention, can spray water to the corners which are dead zones when the rotary spray rotates and sprays water in the washing space. Thus, the present invention enhances a washing effect of the tableware washing machine and increases utility of the washing space.

What is claimed is:

1. A water spray apparatus for spraying water to tableware in a tableware washing machine in which a washing space is formed for washing the contained tableware with the sprayed water, the water spray apparatus comprising:

a body defining the space;

a rotatable water spray device mounted for rotation about an axis in the space and having a plurality of nozzles for spraying water while rotating, the water spray device arranged such that some of the nozzles rotate in a non-circular pattern about the axis;

means for supplying water to the water spray device; and means for allowing the water spray device to rotate;

said water spray device comprising a main nozzle member which is rotatably supported, and an auxiliary nozzle member which is connected with at least one end of the main nozzle member, in a manner that the auxiliary nozzle member is displaced relative to the main nozzle member during rotation of the water spray device;

the nozzle member comprising a hinge accommodation member and a guiding groove which are concentrically formed in the at least one end of the main nozzle member;

the auxiliary nozzle member comprising a hinge portion which is rotatably accommodated in the hinge accommodation member, a guiding rib which is guided along the guiding groove, and the hinge portion having an opening which is fluidly communicable with the main nozzle member.

2. The water spray apparatus according to claim 1, further comprising a spring member for elastically pressing said guiding rib after being inserted into said guiding groove, in order to elastically bias said auxiliary nozzle member in the same direction as the rotational direction of said main nozzle member.

3. The water spray apparatus according to claim 2, further comprising a stopper disposed between said main nozzle member and said auxiliary nozzle member, for preventing said guiding rib from excessively rotating due to said spring member.

4. The water spray apparatus according to claim 1, further comprising means for reducing a contact resistance between the end of said auxiliary nozzle member and said walls.

5. The water spray apparatus according to claim 4, wherein said contact resistance reduction means comprises:

a roller for contacting said walls on a rolling contact manner;

a roller bracket having a support piece for supporting said roller;

a rotational support ring for rotatably supporting said roller bracket; and a support portion formed in said auxiliary nozzle member, for fixing said rotational support ring.

6. The water spray apparatus according to claim 1 wherein the opening is opened and closed in response to rotation of the auxiliary nozzle member relative to the main nozzle member.

7. The water spray apparatus according to claim 6, wherein said roller contacts said walls on a point to point basis.

8. The water spray apparatus according to claim 1, wherein said auxiliary nozzle member is separably connected by a connection tube having said hinge portion and said guiding rib and a nozzle tube on which nozzles are formed.

9. The water spray apparatus according to claim 1, further comprising an additional plate covering said auxiliary nozzle member in order to prevent a thermal variation of said auxiliary nozzle member.

10. The water spray apparatus according to claim 1, wherein said means for supplying water to said water spray comprises a pump for pumping water to said water spray, and said means for rotating said water spray uses a water spraying pressure of the water pumped by said pump.

11. The water spray apparatus according to claim 1 wherein the body includes vertical inner walls forming the space, a distance between the vertical inner walls and an axis of rotation of the main nozzle member changing as the water spray device rotates, the auxiliary nozzle member being engageable with the inner walls and being displaceable relative to the main nozzle member as said distance changes.

12. The water spray apparatus according to claim 11 wherein the auxiliary nozzle member is hinged to the main nozzle member for rotation relative thereto about a vertical axis.

13. The water spray device according to claim 11 wherein the auxiliary spray device includes a roller for engaging the inner walls.

14. A water spray apparatus for spraying water to tableware in a tableware washing machine in which a washing space is formed by walls for washing the contained tableware with the sprayed water, the water spray apparatus comprising:

a body defining the space;

a rotatable water spray device mounted for rotation about an axis in the space and having a plurality of nozzles for spraying water while rotating, the water spray device arranged such that some of the nozzles rotate in a non-circular pattern about the axis;

means for supplying water to the water spray device;

means for allowing the water spray device to rotate;

said water spray device comprising a main nozzle member which is rotatably supported, and an auxiliary nozzle member which is connected with at least one end of the main nozzle member, in a manner that the auxiliary nozzle member is displaced relative to the main nozzle member during rotation of the water spray device; and means for reducing a contact resistance between the end of said auxiliary nozzle member and said walls, comprising:

a roller for contacting said walls in a rolling contact manner, a roller racket having a support piece for supporting said roller, and a bracket holder formed in said auxiliary nozzle member, for fixing said roller bracket.

* * * * *